US005106157A

United States Patent [19]

Nagelkirk et al.

[11] Patent Number: 5,106,157

[45] Date of Patent: Apr. 21, 1992

[54] CHAIR HEIGHT AND TILT ADJUSTMENT MECHANISMS

[75] Inventors: Robert A. Nagelkirk, Zeeland; Lynne M. Allen; Mark E. Kuyper, both of Holland, all of Mich.

[73] Assignee: Herman Miller, Inc., Zeeland, Mich.

[21] Appl. No.: 317,582

[22] Filed: Mar. 1, 1989

[51] Int. Cl.[5] ..... A47C 1/032; A47C 3/30

[52] U.S. Cl. ..... 297/304; 297/301; 297/345; 297/342

[58] Field of Search ..... 297/300–304, 297/345, 342

[56] References Cited

U.S. PATENT DOCUMENTS

| | | | |
|---|---|---|---|
| 2,272,980 | 2/1942 | McLellan . | |
| 2,471,024 | 5/1949 | Cramer . | |
| 2,479,175 | 8/1949 | McArthur . | |
| 2,686,558 | 8/1954 | Fox . | |
| 2,956,619 | 10/1960 | Scherer . | |
| 3,201,079 | 8/1965 | Doetsch . | |
| 3,674,308 | 7/1972 | Radding . | |
| 3,758,157 | 9/1973 | Fries . | |
| 3,788,587 | 1/1974 | Stemmler . | |
| 3,921,952 | 11/1975 | Wirges . | |
| 4,154,477 | 5/1979 | Swenson et al. . | |
| 4,312,728 | 2/1982 | Falks . | |
| 4,328,943 | 5/1982 | Eldon, III | 297/304 |
| 4,373,692 | 2/1983 | Knoblauch et al. . | |
| 4,375,301 | 3/1983 | Pergler et al. . | |
| 4,390,206 | 6/1983 | Falks et al. . | |
| 4,408,800 | 10/1983 | Knapp . | |
| 4,438,898 | 3/1984 | Knoblauch et al. . | |
| 4,451,085 | 5/1984 | Franck et al. . | |
| 4,479,679 | 10/1984 | Fries et al. . | |
| 4,529,247 | 7/1985 | Stumpf et al. . | |
| 4,537,445 | 8/1985 | Neuhoff . | |
| 4,589,697 | 5/1986 | Bauer et al. | 297/300 |
| 4,595,237 | 6/1986 | Nelsen . | |
| 4,640,547 | 2/1987 | Fromme . | |
| 4,652,050 | 3/1987 | Stevens . | |
| 4,653,806 | 3/1987 | Willi . | |
| 4,709,963 | 12/1987 | Uecker et al. | 297/300 X |
| 4,743,065 | 5/1988 | Meitler et al. | 297/301 X |
| 4,744,600 | 5/1988 | Inoue | 297/304 X |
| 4,832,402 | 5/1989 | Zund | 297/302 |
| 4,858,993 | 8/1989 | Steinmann | 297/304 X |

FOREIGN PATENT DOCUMENTS

| | | | |
|---|---|---|---|
| 691437 | 4/1940 | Fed. Rep. of Germany . | |
| 3322450 | 1/1985 | Fed. Rep. of Germany | 297/360 |
| 708283 | 7/1931 | France . | |
| 164790 | 10/1933 | Switzerland . | |
| 273039 | 4/1951 | Switzerland . | |
| 15751 | of 1914 | United Kingdom . | |
| 222898 | 10/1924 | United Kingdom . | |
| 385157 | 12/1932 | United Kingdom . | |
| 770169 | 3/1957 | United Kingdom . | |
| 794138 | 4/1958 | United Kingdom . | |
| 1278501 | 6/1972 | United Kingdom . | |

*Primary Examiner*—Peter R. Brown

*Attorney, Agent, or Firm*—Varnum, Riddering, Schmidt & Howlett

[57] ABSTRACT

A chair comprises a base, a column on the base, a housing on the column and supporting a chair seat and back, a height adjustment mechanism mounted to and between the base and the housing for longitudinal adjustment to alter relative height of the seat. The chair also includes a tilt adjustment mechanism comprising a chair back support pivotally mounted to the housing for movement between upright and reclining positions, a member for biasing the chair back support in the upright position, a tension control mechanism movably engageable with the biasing member for adjusting tension thereof and a tilt actuating member movably mounted to the housing for actuating movement of the tension control mechanism. The tilt actuating member comprises an elongated rod rotatably mounted to the housing. The height actuating member comprises an elongated tube rotatably mounted to the housing in telescopic relationship to the actuating rod.

50 Claims, 5 Drawing Sheets

CHAIR HEIGHT AND TILT ADJUSTMENT MECHANISMS

FIELD OF THE INVENTION

The invention relates to a chair and, more particularly, to mechanisms for adjusting the height and tilt of a chair.

BACKGROUND OF THE INVENTION

Chairs having mechanisms permitting tilting of the chair backs, normally being biased in upright positions, are disclosed in U.S. Pat. Nos. to Faiks et al. 4,390,206, issued June 28, 1983; Knoblauch et al. 4,373,692, issued Feb. 15, 1983, and 4,438,898 issued Mar. 27, 1984; Faiks 4,314,728, issued Feb. 9, 1982; Fox 2,686,558, issued Apr. 27, 1950; Fries et al. 4,479,679, issued Oct. 30, 1984; Neuhoff 4,537,445, issued Aug. 27, 1985; Eldon III 4,328,943, issued May 11, 1982; McLellan et al. 2,272,980, issued Feb. 10, 1942; Scherer 2,956,619, issued Oct. 18, 1960; Cramer 2,471,024, issued May 24, 1949; and Franck et al. 4,451,085, issued May 29, 1984. Some of these patents disclose chairs having control means for adjusting tension of biasing means normally urging the chair backs in the upright positions. See, for example, Faiks et al., Knoblauch et al., Faiks, Scherer, Cramer, Fries et al., and Eldon III. In addition, chairs incorporating mechanisms permitting adjustment of chair height are known. For example, height adjustment mechanisms are disclosed in U.S. Pat. Nos. to Faiks et al.; Knoblauch et al.; Faiks; Eldon III; Neuhoff; Stemmler, 3,788,587, issued Jan. 29, 1974; Wirges, 3,921,952, issued Nov. 25, 1975; and Knapp, 4,400,800, issued Oct. 11, 1983.

SUMMARY OF THE INVENTION

According to the invention, there is provided a height adjustment mechanism adapted for use in connection with a chair. The chair comprises a base, a column on the base and support means mounted on the column and supporting a chair seat. The mechanism comprises extendable means adapted to be positioned within the column and mounted to and between the base and the support means for longitudinal adjustment to alter height of the seat relative to the base. The mechanism also comprises lock means movable between locked and unlocked positions to prevent and permit, respectively, adjustment of the extendable means. The mechanism further comprises means for actuating movement of the lock means to the unlocked position. The actuating means is adapted to be mounted to the support means for rotational movement about a longitudinal axis of the actuating means in actuating and return directions and is adapted to actuate movement of the lock means to the unlocked position when the actuating means is rotated in the actuating direction.

The mechanism also includes a lever means adapted to be movably mounted to the support means to engage the lock means to move the lock means to the unlocked position. To this end, the actuating means comprises means for engaging the lever means to move the lock means to the unlocked position when the actuating means is rotated in the actuating direction. A biasing means is provided by the extendable means to urge the lock means in the locked position, the biasing means urging the lever means out of engagement with the lock means and the actuating means in the return direction.

In another aspect of the invention, the same comprises a chair having a base, a column mounted on the base and a tilt adjustment mechanism comprising a housing mounted on the column, chair back support means pivotally mounted on the housing for movement between reclining and upright positions, chair seat support means mounted on the housing for movement in rearward and forward directions and operably connected to the chair back support means, biasing means mounted on the housing and biasing the seat support means and the back support means in the upright and forward positions, respectively, an adjustable tension control means for adjusting tension of the biasing means. The tension control means operably engages the biasing means, is mounted for transverse movement relative to the rearward and forward directions and for movement in the rearward and forward directions, and comprises force transmitting means for translating the transverse movement of the tension control means into movement of the control means in the forward and rearward directions to increase and decrease, respectively, tension of the biasing means.

The tension control means comprises a first block-like member mounted in the housing for reciprocal movement in first and second directions transverse of the rearward and forward directions, a second block-like member engaging the biasing means and mounted in the housing for reciprocal movement in the forward and rearward directions, and means for actuating reciprocal movement of the first member in the first and second directions, the force transmitting means being adapted to coact between the first and second members to translate movement of the first member in the first and second directions into movement of the second member in the forward and rearward directions to increase and decrease, respectively, tension of the biasing means.

The force transmitting means comprises complementary planar surfaces on the first and second block-like members and interengaged in a substantially common plane forming an acute angle greater than 0° relative to directional movement of the first block like member.

The actuating means comprises a rod mounted to the housing for rotational movement in tension and release directions. The first block-like member is mounted to the actuating rod for movement longitudinally thereof in the first and second directions. The tension control means further comprises second forced transmitting means for translating rotational movement of the rod in the tension and release directions into movement of the first block-like member in the first and second directions, respectively. In this manner, rotation of the actuating rod in the tension and release directions moves the first member in the first and second directions and the second member in the forward and rearward directions to increase and decrease, respectively, tension of the biasing means.

A further aspect of the invention contemplates a chair control for adjusting height and tilt of a chair. The chair comprises a base and a column supported by the base. The chair control comprises height adjustment means, tilt adjustment means and a housing adapted to mount on the column and supporting a chair seat. The height adjustment means is mounted to and between the base and the housing for longitudinal adjustment to alter relative height of the seat and comprises height actuating means movably mounted to the housing for actuating longitudinal adjustment of the height adjustment means. The tilt adjustment means comprises chair back support means pivotally mounted on the housing for movement between upright and reclining positions, means for biasing the chair back support means in the upright position, tension control means movably engageable with the biasing means for adjusting tension thereof and tilt actuating means movably mounted to the housing for actuating movement of the tension control means. The height actuating means and the tilt actuating means comprise a pair of discrete members extending coaxially and codirectionally outwardly from the housing.

The height actuating means and the tilt actuating means are mounted to the housing for rotational movement about a common longitudinal axis. The tilt actuating means comprises a rod rotatably mounted to the housing. The height actuating means comprises a tube rotatably mounted to the housing in telescopic relationship to the rod.

BRIEF DESCRIPTION OF THE DRAWINGS

The invention will now be described with reference to the drawings in which.

DESCRIPTION OF THE PREFERRED EMBODIMENTS

Figure 1:
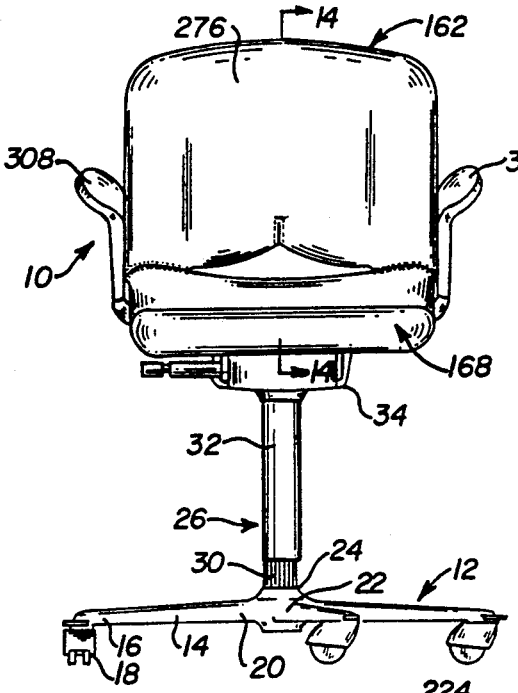
FIG. 1 is a front elevational view of a chair in accordance with the invention.
Figure 2:
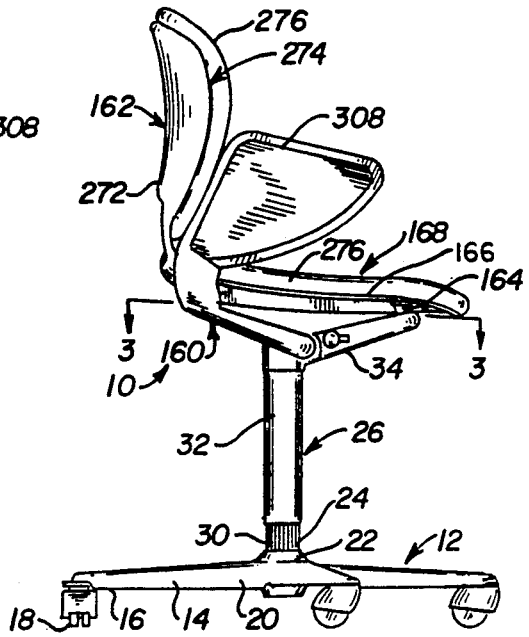
FIG. 2 is a side elevational of the chair shown in FIG. 1.

The principles of the invention are disclosed, by way of example, in a chair 10 as generally shown in FIGS. 1 and 2. Individual components of the chair 10 are further shown in FIGS. 3–15. As described in detail herein, the chair 10 includes a tilt mechanism for providing rearward and downward adjustment of the chair back and seat relative to normally upright and forward positions of the back and seat and a mechanism for adjusting height of the chair back and seat relative to a chair base.

Referring specifically to FIGS. 1 and 2, the chair 10 comprises a castered base 12 having five equidistantly spaced arms 14 mounting at outer ends 16 thereof floor engaging casters 18. Inner ends 20 of the arms 14 are connected by a central web 22 having a central socket 24 therethrough. The arms 14 and the central web 22 are preferably a casted one-piece aluminum member. Although the base 12 is illustrated as having five arms, any other number of arms can be used to provide the necessary support for the chair, so long as the number is sufficient to provide stability to the chair. Further, other conventional chair bases may be substituted for that illustrated and described without departing from the spirit and scope of the invention.

Figure 4:
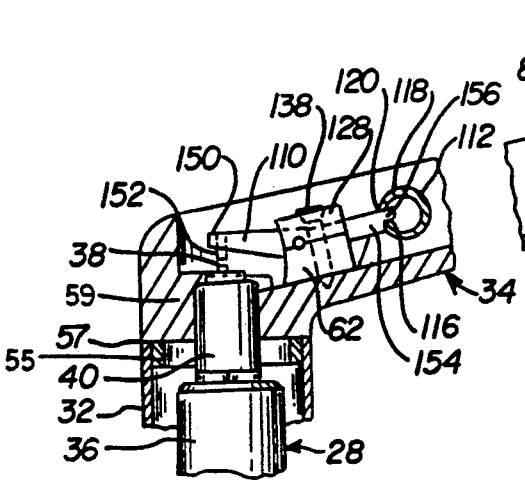
FIG. 4 is a sectional view of the housing taken along lines 4—4 of FIG. 3.

In addition, the chair 10 includes an adjustable column 26. As shown in FIGS. 1,2, and 4, the column 26 includes a pneumatic air spring 28 (hereinafter sometimes the "extendable means") positioned within a pair of telescoping inner and outer cover tubes 30, 32. The air spring 28 is mounted to and between the base 12 and a housing 34 (hereinafter sometimes the "support means") of the chair.

Specifically, the air spring 28 comprises a piston (not shown and hereinafter sometimes the "first member") securely mounted to the web 22 and a cylinder 36 (hereinafter sometimes the "second member") mounted to the housing 34 as described in detail below. The air spring 28 further includes a pin 38 (hereinafter sometimes the "lock means") projecting upwardly from an upper axial end 40 of the cylinder 36. The pin 38 is adapted to move between an upper locked position, where the cylinder 36 and the piston are held in stationary locked engagement, and a lower unlocked position, where the cylinder and the piston are released for movement relative to each other to extend or contract the air spring 28 longitudinally. The pin 38 is normally biased in the upper locked position by compressed gas (hereinafter sometimes the "biasing means") housed within the cylinder.

The inner cover tube 30 is mounted on the web 22 over the air spring 28, and in particular the piston. The outer cover tube 32 is mounted to the chair housing 34 over the cylinder 36 as described below.

Referring to FIGS. 3–6, the housing 34 is generally pentagonal in shape and comprises a bottom wall 42, a front wall 44, a pair of parallel side walls 46 and a pair of identical rearwardly converging back walls 48. The bottom wall 42 has an opening 50 therethrough at a rear portion 52 of the housing and at an apex 54 defined by the converging back walls 48. The housing 34 further includes a first hollow cylindrical portion 55 forming a downward extension of the opening 50 and having a step portion 57. A second hollow cylindrical portion 59 forms an upward extension of the opening 50.

In addition, the housing 34 includes pairs of transverse and longitudinal flanges 56, 58, 60, 62 formed integral with and extending upwardly from the housing bottom and side walls 42, 46. The flanges 56, 58 extend inwardly a predetermined distance from the side walls 46 along transverse axes of the housing 34. The flanges 60 extend forwardly a predetermined distance from inner edges 64 of the flanges 58 along longitudinal axes of the housing 34. A central longitudinal groove 66 is formed in the bottom wall 42. The flanges 56, 58, 60 and the groove 66 function in connection with the tilt adjustment mechanism as discussed below in detail. The flanges 62 are positioned between the opening 50 and the flanges 56 and along longitudinal axes of the housing 34 adjacent the rear portion 52 thereof. The flanges 62 function in connection with the height adjustment mechanism as hereinafter described.

The housing 34 also includes a pair of shoulders 68 at a front portion 70 of the housing 34 on opposite lateral sides 88, 90 thereof. Each shoulder 68 includes a front step portion 72 having an upper surface 74 which first slopes downwardly and rearwardly and then curves upwardly. Each shoulder 68 has mounted thereon a retainer 76 also having a step portion 78. The step portion 78 has a rearwardly and downwardly curving lower surface 80 complementary to the upper surface 74 of the respective shoulder. Each shoulder 68 and the respective retainer 76 are secured together and to the housing bottom wall 42 by a screw 82 threaded in aligned holes 83 in the retainer, the shoulder and the bottom wall. The complementary upper and lower surfaces 74, 80 form a partially oval slot 84 which slopes slightly downwardly and rearwardly. The slot 84 functions in connection with the tilt adjustment mechanism as described below.

The housing 34 further comprises a pair of through openings 86 positioned at the lateral sides 88, 90 of the housing and extending through gusset-like members 92 at the interface between the housing parallel side walls 46 and the converging back walls 48. The openings 86 function in connection with the tilt adjustment mechanism. The side wall 46 at the housing lateral side 88 has a bore 94 therethrough forward of the socket 86. Another bore 96 transversely aligned with the bore 94 extends partially through the side wall 46 at the lateral side 90 of the housing 34. The transversely aligned bores 94, 96 function in connection with both the tilt and height adjustment mechanisms. The housing 34 is preferably made of an aluminum alloy.

Figure 13:
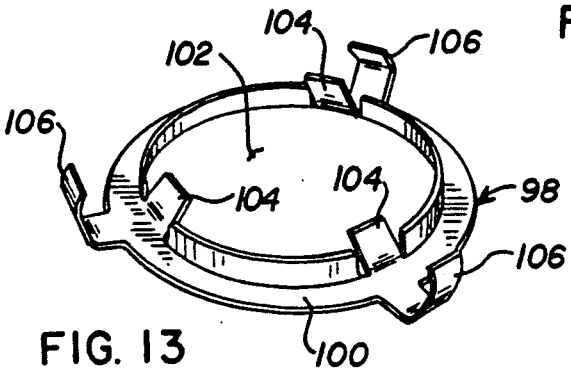
FIG. 13 is a perspective view of a cover tube retaining bracket in accordance with the invention.
Figure 14:
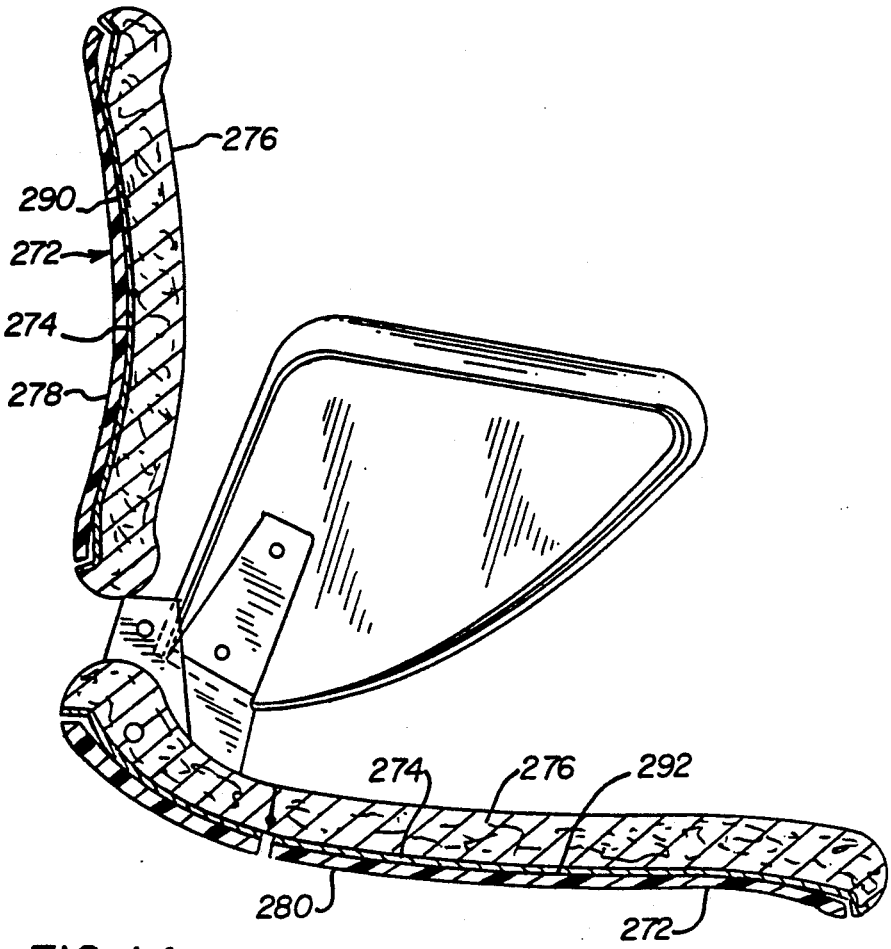
FIG. 14 is a sectional view of the chair seat and back taken along lines 14—14 of FIG. 1.

As stated above, the air spring 28 and the column 26 are mounted to the housing 34. To this end, as shown in FIGS. 13, a retainer 98 is provided. The retainer 98 is a ring-like member having a body 100 defining a central opening 102. The retainer 98 further includes a plurality of inwardly and outwardly projecting spring-like tabs 104, 106 on the body 100 for securing the column 26 and the air spring 28 to the housing 34. Specifically, the inwardly projecting tabs 104 function to mount the retainer 98 to the lower cylindrical portion 55 of the housing 34 in a compression fit relationship (See FIG. 4.). The outwardly projecting tabs 106 function to retain the outer cover tube 32 of the column 26 to the housing 34 with the outer cover tube engaging the step portion 57 of the lower cylindrical portion 55 of the housing. The air spring 28 is positioned in registry with the openings 102, 50 in a compression fit relationship to the housing 34.

Referring again to FIGS. 3 and 4, the height adjustment mechanism comprises the air spring 28 heretofore described, a bar 110 (hereinafter sometimes the "lever means") movably mounted to the housing 34 and an actuating tube 112 (hereinafter sometimes the "actuating means") also movably mounted to the housing, the actuating tube being adapted to actuate movement of the bar to engage the pin 38 of the air spring 28 and to move the pin to its unlocked position to permit vertical adjustment of the air spring and thus the chair 10.

The actuating tube 112 is rotatably mounted to the housing side wall 46, at the lateral side 88 of the housing 34, in registry with the bore 94. An inner portion 114 of the tube 112 is positioned within the housing 34 and has a rearwardly facing opening 116 extending through wall 118 of the tube. The opening 116 is defined by an edge 120 of the tube wall 118. An outer portion 122 of the tube 112 is positioned outside of the housing 34 and has telescopically mounted thereon a handle 124 carrying a knob 126 normally positioned in a horizontal orientation.

Figures 18A, 18B:
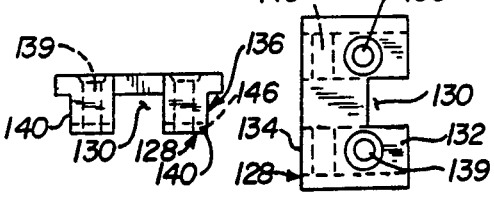
FIG. 18A is a top plan view of a retainer bracket of the height adjustment mechanism in accordance with the invention.
FIG. 18B is a side elevational view thereof.
Figure 18C:
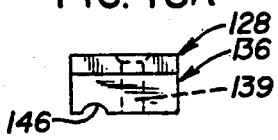
FIG. 18C is a front elevational view thereof.
Figure 19A:
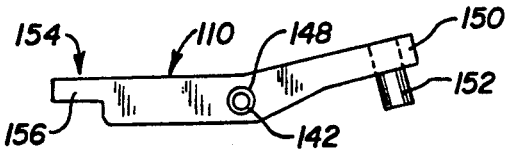
FIG. 19A is a side elevational view of a lever bar of the height adjustment mechanism in accordance with the invention.
Figure 19B:
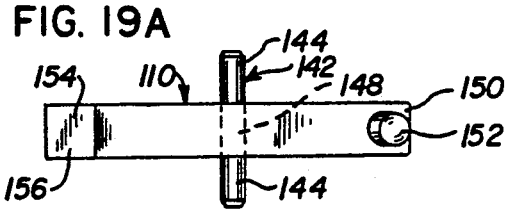
FIG. 19B is a bottom plan view thereof.

The lever means or bar 110 is pivotally mounted to and between the housing flanges 62 for engagement with the air spring 38 to move the same to its unlocked position. To this end, and as shown more clearly in FIGS. 18A–18C, retainer bracket 128 is provided. The retainer bracket 128 is a generally rectangular member having a channel 130 therethrough along a central transverse axis between a front 132 of the bracket and a back 134 of the same. The channel 130 extends entirely through the bracket front 132, but merely extends through a bottom portion 136 of the bracket at the back 134. The bracket 128 is mounted to the flanges by a pair of screws 138 extending through two sets of aligned holes 139 in the bracket, the flanges and the bottom wall. The bracket 128 is positioned on the flanges 62 such that the channel 130 is aligned between the flanges. Referring again to FIGS. 3 and 4, and also with reference to FIGS. 19 and 19B, The bar 110 is positioned between the flanges 62 in registry with the channel 130 and is pivotally mounted to the bracket 128 between opposite lower portions 140 thereof defined by and positioned on opposite sides of the channel 130 by a pin 142, opposite ends 144 of which are set in rotatable registry with a pair of aligned sockets 146 in the lower portions 140 and the flanges 62. The pin 142 is received by a central transverse bore 148 of the bar 110 in tight relationship thereto. The channel 130 is of sufficient size to permit free pivotal movement of the bar 110 between the flanges 62.

In an alternative embodiment, the bracket 128 is formed of two bracket parts (not shown) mounted to the flanges 26 in spaced relationship and rotatably carrying the pin 42 between the two bracket parts. In such embodiment, the bar 110 is pivotally carried by the pin between the bracket parts.

A rear end 150 of the bar 110 carries a downwardly depending pin 152 positioned for engagement with the pin 38 of the air spring 28 upon pivotal movement of the bar. A forward end 154 of the bar includes a step portion 156 positioned in registry with the opening 116 through the actuating tube 112. The actuating tube, the bar and the retainer bracket are preferably made of metal. The adjustment knob is preferably formed of plastic.

In operation of the height adjustment mechanism, downward force applied to the knob 126 causes rotation of the actuating tube 112 in a clockwise direction forcing the tube edge 120 against the forward end 154 of the bar 110 to force and move the same upwardly and the rear end 150 of the bar downwardly. Downward movement of the bar rear end 150 forces the downwardly depending pin 152 thereon against the pin 38 of the air spring 28 to move the pin 38, against the biasing force of the pressurized gas contained in the cylinder 36, to its lower unlocked position to release the cylinder from locked engagement relative to the piston (not shown) thereby permitting chair height adjustment. Release of the knob 126, after the desired chair height is attained, permits the biasing means to force the air spring pin 38 to its upper locked position and the bar rear end 150 upwardly to effect downward movement of the bar front end 154. Downward movement of the bar front end 154 forces the step portion 156 thereon against the edge 120 of the actuating tube 112 to effect rotation of the tube in the counterclockwise direction and the handle knob 126 to its original horizontal orientation.

As illustrated in FIGS. 2, 3 and 5–10, the tilt adjustment mechanism comprises means 160 for supporting a back 162 of the chair 10 (hereinafter sometimes the "chair back support means" or the "yoke") and pivotally mounted on the housing 34 for movement between reclining and upright positions; means 164 for supporting a seat 166 of the chair (hereinafter sometimes the "seat support means" or the "plunger") mounted on the housing for movement in forward and rearward directions; means 168 pivotally connecting the chair back support means 160 and the seat support means 164 (hereinafter sometimes the "pivot means"); means 170 biasing the seat support means and the back support means in the forward direction and the upright position, respectively; and tension control means 172 for adjusting the tension of the biasing means.

Figure 3:
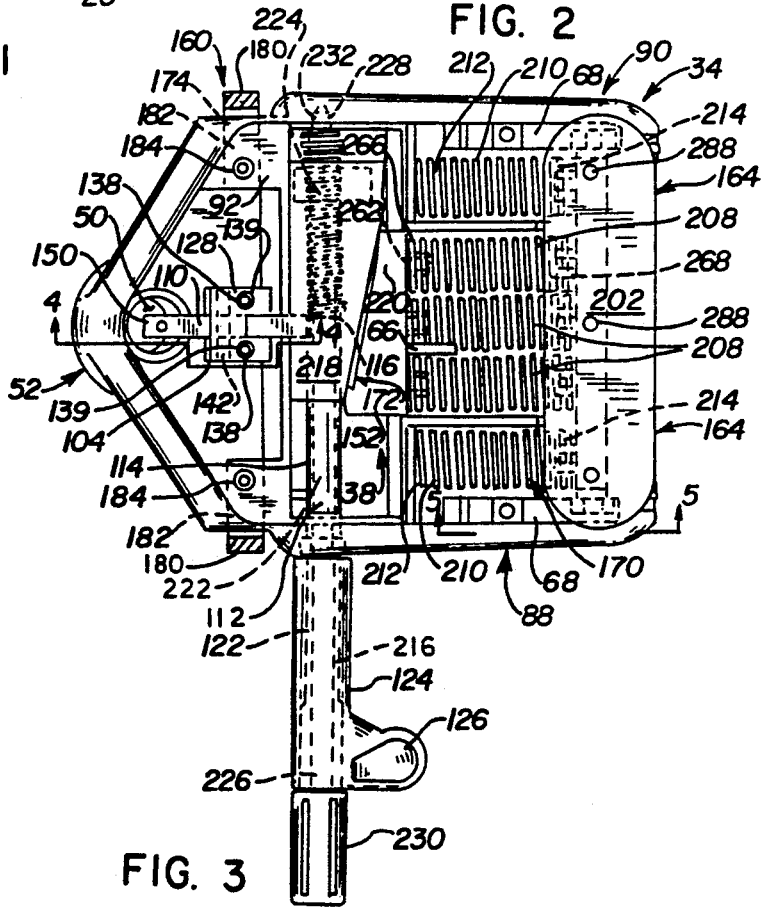
FIG. 3 is a plan view of a housing of the chair, the housing mounting chair tilt and height adjustment mechanisms in accordance with the invention.
Figure 7:
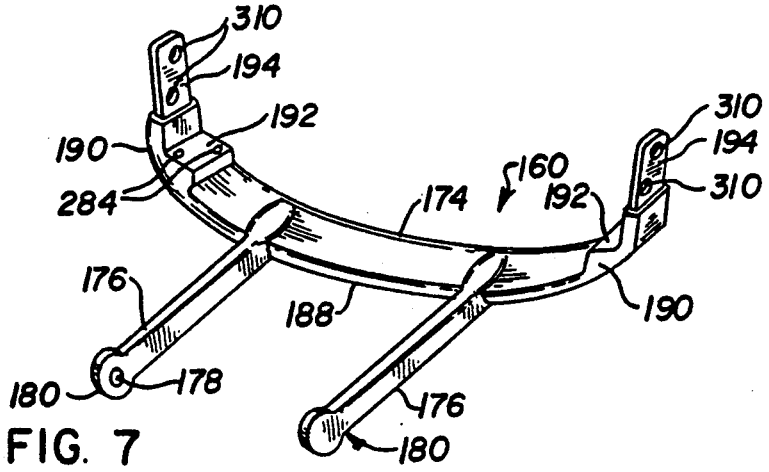
FIG. 7 is a perspective view of a seat support means or yoke of the tilt adjustment mechanism in accordance with the invention.

Referring specifically to FIGS. 3 and 7, the chair back support means or yoke 160 comprises a U-shaped support 174 and two parallel, spaced-apart arms 176. As stated above, the yoke 160 is rotatably mounted to the housing 34 for movement between upright and reclining positions. To this end, each arm 176 has a socket 178 on an outer end 180 of the arm rotatably receiving yoke pins 182. The yoke pins 182 are in turn rotatably mounted to the housing 34 in registry with the through openings 86 at opposite lateral sides 88, 90 of the housing. Screws 184 extend through aligned holes 186 in the housing gusset-like members 92 to, in combination with the arms 176, retain the pins within the openings 86. The arms 178 are sufficiently spaced and are of sufficient length to allow for free rotation of the yoke 160 relative to the housing 34.

The U-shaped support 174 comprises a web portion 188 and upwardly curving side portions 190. The side portions 190 have identical horizontal step portions 192 and identical vertical end portions 194. The step portions 192 function to support the chair back 162 as described below. The end portions 194 facilitate placement of chair armrests as is also described below. The yoke 160 is preferably made of cast aluminum.

Figure 5:
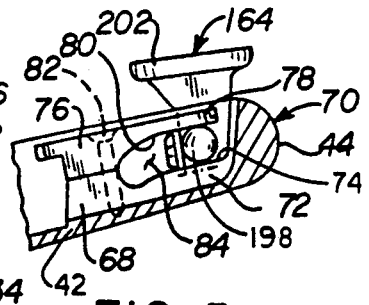
FIG. 5 is a sectional view of the housing taken along lines 5—5 of FIG. 3.
Figure 6:
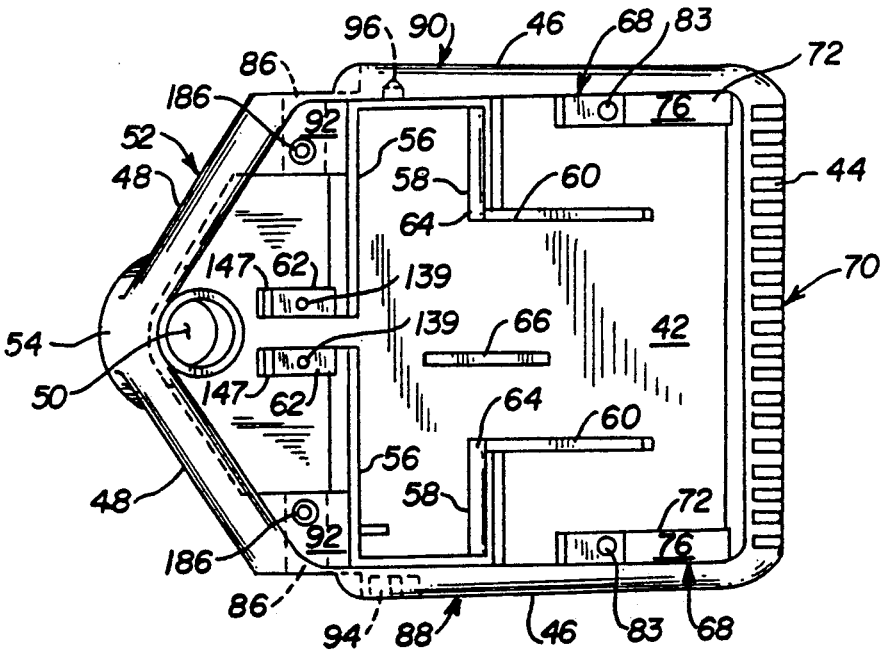
FIG. 6 is a plan view of the housing.
Figure 10:
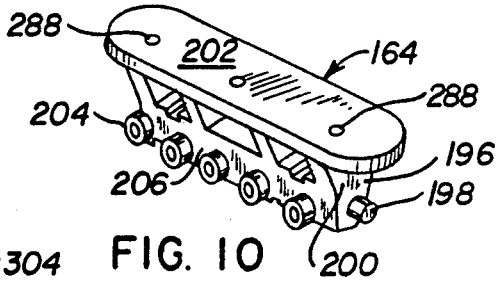
FIG. 10 is a perspective view of a seat support means or plunger of the tilt adjustment mechanism.

As illustrated in FIGS. 3, 5 and 10 the seat support means or plunger 164 is pivotally and slidably mounted to the housing 34 for movement in rearward and forward directions. To this end, the plunger 164 comprises a generally T-shaped body 196 and an outwardly projecting pin 198 on each lateral side wall 200 of the body. The pins 198 are rotatably and slidably received within the arcuate slots 84 at the front portion 70 of the housing 34 to slidably mount the plunger to the same. The T-shaped body 196 further includes an upper horizontal plate like portion 202 to which the chair seat 166 is mounted as described below. In this manner, the seat 166 is movable along with the plunger 164 in the forward and rearward directions during operation of the tilt adjustment mechanism. The plunger 164 further includes a plurality of rearwardly projecting pins 204 on a back wall 206 of the body 196. The pins 204 function in connection with the biasing means 170 as discussed below.

Although the slots 84 can be linearly formed to guide the plunger along a straight path in forward and rearward directions, the slots are preferably slightly curved to guide the plunger along an arcuate path to promote smooth operation of the tilt adjustment mechanism.

Referring to FIG. 3, the biasing means 170 comprises sets of adjustable and nonadjustable springs 208, 210, respectively, mounted within the housing 34 in such a manner as to resist movement of the seat support means or plunger 64 in the rearward direction and the back support means or yoke 160 toward the reclining position. Specifically, the nonadjustable springs 210 are mounted to and between the housing flanges 58 and the plunger 164, with the spring rear ends 212 bearing against the flanges 58 and the spring front ends 214 bearing against the plunger back wall 206 and receiving certain of the rearwardly projecting pins 204 thereon, the pins assisting in the mounting of the springs within the housing. The adjustable springs 208 are mounted to and between the tension control means 172, as discussed below, and the plunger back wall 206, with the adjustable spring front ends 268 receiving other of the pins 204 on the plunger back wall.

The tension control means 172 functions to adjust tension or potential of the adjustable springs 208 to thereby adjust the same's resistance to rearward movement of the seat support means or plunger 164 and movement of the back support means or yoke 160 toward the reclining position. The tension control means 172 comprises an adjustment rod 216, a wedge 218 (hereinafter sometimes the "first block-like member") and a compression carriage 220 (hereinafter sometimes the "second block-like member").

As illustrated in FIG. 3, the adjustment rod 216 is rotatably mounted to the housing side walls 46 at the housing lateral sides 88, 90 in registry with the bores 94, 96. Specifically, the rod 216 comprises a first portion 222 telescopically received by the actuating tube 112 of the height adjustment mechanism, and a second threaded portion 224 outside of the actuating tube. The rod 216 also includes a first end 226 positioned outside of the housing 34 and the actuating tube 112, and a second end 228 positioned inside of the housing adjacent the threaded portion 224 of the rod. The rod first end 226 carries a knob 230 thereon adjacent the handle 124 of the actuating tube 112. The rod second end 228 carries a pin 232 in rotatable registry with the bore 96 and engaging the side wall 46 at the housing lateral side 90.

Figure 8:
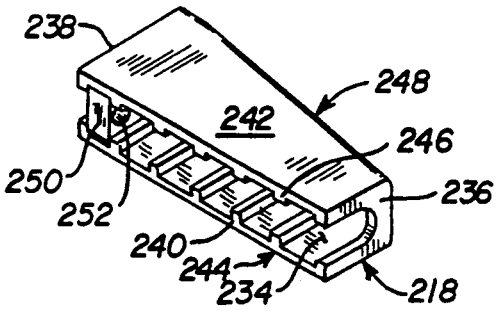
FIG. 8 is a perspective view of a wedge of the tilt adjustment mechanism.

As shown in FIGS. 3 and 8, the wedge 218 is a hollow, substantially right triangular member having a rearwardly opening U-shaped slot 234 through one side wall 236 of the wedge. Opposite side wall 238 is substantially open. A plurality of internal transverse ribs 240 formed on upper and lower sides 242, 244 of the wedge 218 function to enhance structural rigidity of the same. A back side 246 of the wedge is also substantially open, a sloping front wall 248 thereof being solid. A nut 250 is mounted within the wedge 218 and substantially closes off the open side 238 thereof. The nut 250 includes a threaded hole 252 aligned with the U-shaped slot 234. The inner portion 114 of the actuating tube 112, and the adjustment rod 216 received therein, is positioned within the wedge 218 in registry with the U-shaped slot 234. The second threaded portion 224 of the rod 216 engages the nut 250 in registry with the hole 252. The wedge 218 is preferably made of plastic, such as Delrin.

The wedge 218 is positioned within the housing between the bottom wall 42 thereof and a top wall or cover 254 of the housing. The cover 254 is not specifically shown in FIG. 3, but is illustrated in greater detail in FIG. 11. The bottom and top walls 42, 254 (hereinafter sometimes collectively the "interference means") interfere with rotation of the wedge 218 upon rotation of the actuating rod 216 to effect linear movement of the wedge in first and second directions normal to movement of the seat support means 164 in the forward and rearward directions. The wedge 218 also slidably engages and is positioned between the housing flanges 56, 58. The flanges 56, 58 are longitudinally aligned with directional movement of the wedge 218 and therefore function to guide the same in the first and second directions.

Figure 9:
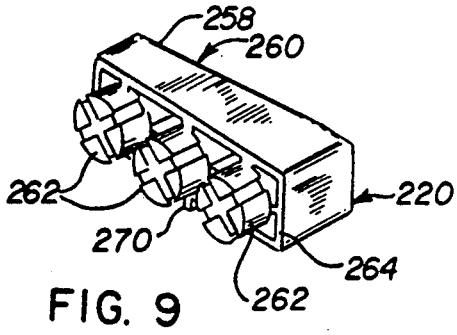
FIG. 9 is a perspective view of a carriage of the tilt adjustment mechanism.

Referring to FIGS. 3 and 9, the carriage 220 comprises a somewhat triangular body 258 having a sloping rear face 260 complementary with and engaging the sloping front wall 248 of the wedge 218. As stated above, the adjustable coil springs 208 of the biasing means 170 are positioned between the seat support means 164 and the tension control means 172. To this end, the carriage 220 includes a plurality of forwardly protecting pins 262 on a front face 264 of the carriage. The pins 262 receive rear ends 266 of the adjustable springs 208, front ends 268 thereof being received by the pins 204 of the seat support means as heretofore described. The carriage 220 is moveable in the housing 34 in the forward and rearward directions of the seat support means and is biased for movement in the rearward direction against the wedge 218, with the rear face 260 of the carriage in mating engagement with the complementary sloping front wall 248 of the wedge. The carriage is preferably made of a glass filled nylon material such as Zytel.

The carriage 220 engages and is movably position between the housing flanges 60. In this manner, the flanges 60 function to guide movement of the carriage in the forward and rearward directions. The carriage 220 further includes a downwardly extending flange 270 slidably received within the longitudinal groove 66 of the housing 34. The flange 70 and the groove 66 also function to guide the carriage 220 between the forward and rearward directions.

The complementary rear face 260 and the front wall 248 of the carriage 220 and the wedge 118, respectively are interengaged in a substantially common plane forming an acute angle relative to directional movement of the wedge in the first and second directions. In this manner, in operation of the tension control means 172, rotational adjustment of the actuating rod 216 effects movement of the wedge 218 in the first and second directions and the carriage 220 in the forward and rearward directions to increase and decrease tension of the the adjustable springs 208. Thus, forward movement of the carriage 220 increases the compressive force of the springs 208, thereby increasing the resistance to rearward movement of the seat support means 164 and movement of the back support means 160 to the reclining position. Conversely, rearward movement of the carriage 220 decreases the compressive force of the adjustable springs 208, thereby decreasing the springs' resistance against to rearward movement of the seat support means 164 and movement of the back support means 160 to the reclining position.

As stated above, the pivot means 168 operably connects the seat and back support means and specifically forms a pivotal or hinged connection between the chair seat 166 and the back 162. As shown in FIGS. 1, 2, and 14–16, the seat 166 and the back 162 are formed of a two-piece outer shell 272, a two-piece inner shell 274 and a cushion 276. The outer shell 272 includes an outer back portion 278 and an outer seat portion 280. The outer back portion 278 is securely mounted on the U-shaped support 174 of the back support means 160 by pairs of screws (not shown) engaging and extending through aligned pairs of holes 284 in the outer back portion and the step portion 192 of the U-shaped support. The outer seat portion 280 is securely mounted on the seat support means 164 by a plurality of screws (not shown) engaging and extending through aligned sets of holes 288 in the outer seat portion and the upper plate like portion 202 of the seat support means.

The inner shell 274 comprises an inner back portion 290 and an inner seat portion 292. The inner back and seat portions 290, 292 are mounted to the outer back and seat portions 278, 280, respectively, in snap fit relationship by fastening means well known in the art. The inner back and seat portions 290, 292 are connected together by the cushion 276 adhesively bonded to the inner back and seat portions The cushion 276 is preferably upholstered and serves aesthetic and comfort purposes as well as functioning to connect the inner back and seat portions together. Spaces 293 between the inner and outer shell receive fabric (not shown) covering the seat and back.

Figure 15:
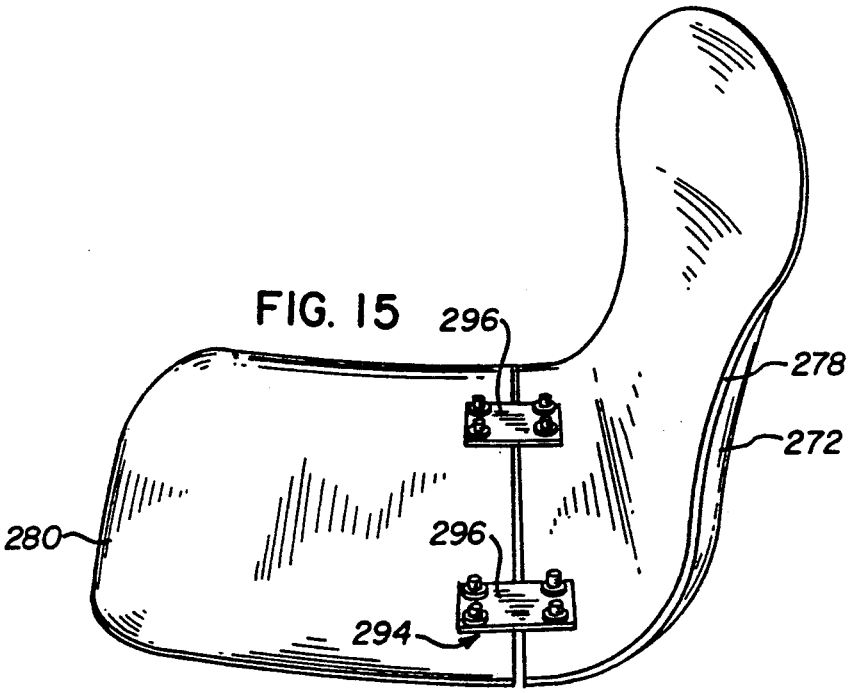
FIG. 15 is a front perspective view of an outer shell of the chair seat and back, showing a composite hinged connection between outer seat and back portions of the outer shell.
Figure 16:
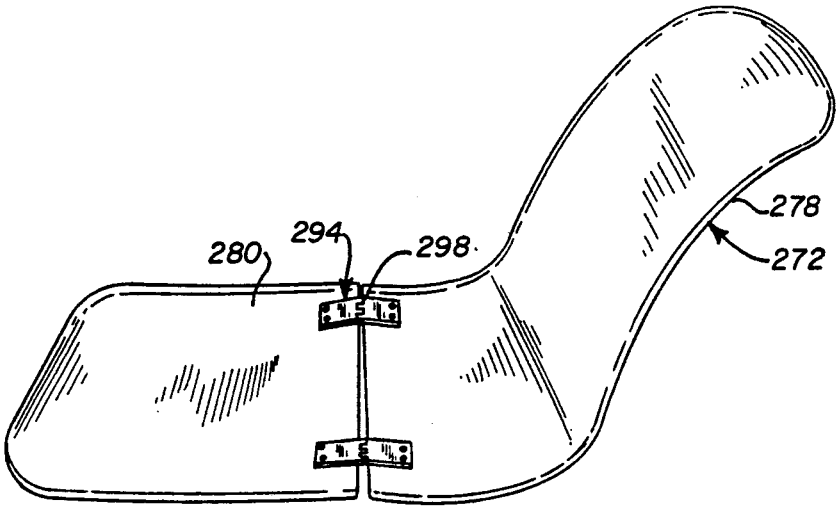
FIG. 16 is a front perspective view of the outer shell of the seat and back, showing a true hinged connection between the outer seat and back portions of the outer shell.

Referring now to FIGS. 15 and 16, the pivot means 168 comprises a hinge 294 mounted to and between the outer back and seat portions 278, 280 to pivotably mount the same together and thus hingeably mount the chair seat 166 to the back 162. As specifically shown in FIG. 15, the hinge 294 preferably comprises at least two, resilient members 296 made of a composite plastic material such as polyisocyanate. The inherent resiliency of the members 296 provides resistance to pivotal movement of the back 162 relative to the seat 166 during downward and rearward tilting of the back support means toward the reclining position. This has been found to provide smoother operation of the chair during such tilting operation than when a true hinge 298 is used to pivotally connect the outer back and seat portions 278, 280 as specifically illustrated in FIG. 16.

The inner and outer shells are preferably made of resilient plastic material such as polypropylene.

Figure 17:
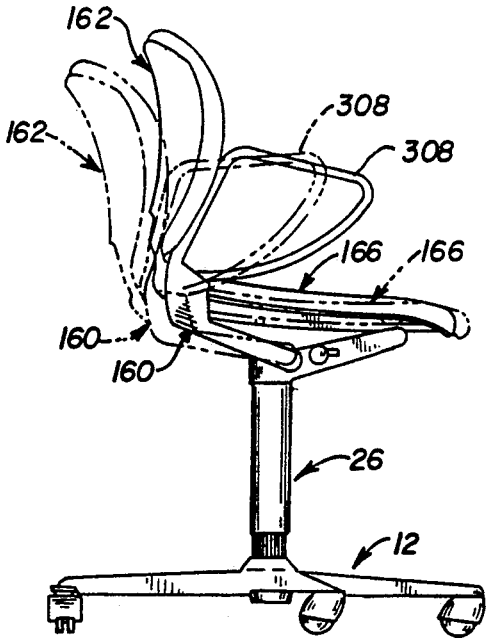
FIG. 17 is a side elevational view of the chair seat and back, showing the same in solid lines in their forward and upright positions and in phantom lines in their rearward and reclining positions.

In operation of the tilt adjustment mechanism, referring specifically to FIG. 17, when rearward and downward forces are applied to the chair back 162, the back support means 160 rotates and pivots counterclockwise, thereby causing the back to move rearwardly and downwardly toward the reclining position and to pivot relative to the seat 166 by virtue of the pivot means 168. At the same time, forces are exerted on the seat 166 causing the seat support means 164 to move rearwardly and slightly downwardly in the arcuate slots 84 in the rearward direction against the force of the adjustable and nonadjustable springs 208, 210. When the rearward forces on the back are released, the springs 208, 210 force the seat support means 164 in the forward direction to thus move the back 162 to its original upright position.

Figure 11:
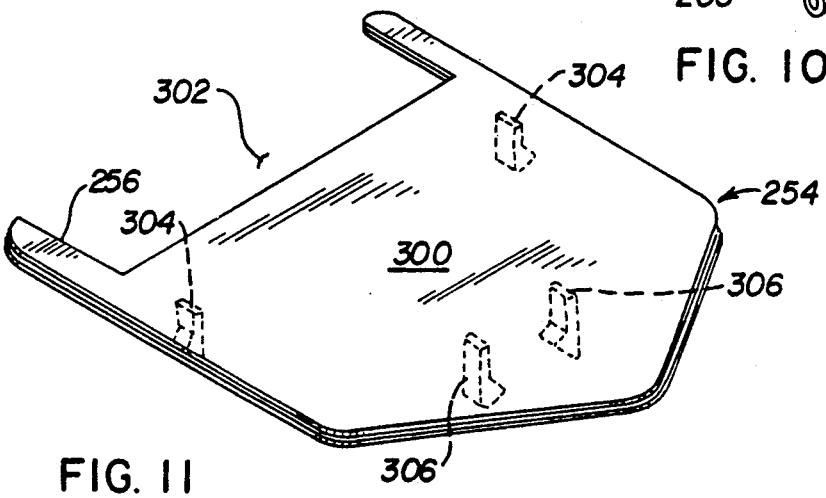
FIG. 11 is a perspective view of a cover or top wall of the housing.
Figure 12:
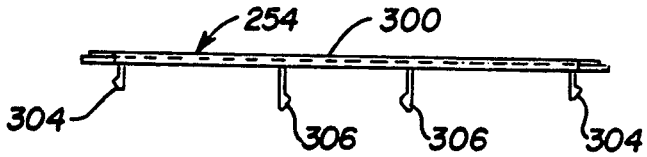
FIG. 12 is a front elevational view of the housing cover.

The housing top wall or cover 254 is mounted on the housing 34 directly below the outer seat portion 280 of the seat 166. The cover 254 functions to protect the tilt and height adjustment mechanism components from dust. As shown in FIGS. 11 and 12, the cover 254 comprises a generally pentagonal plate 300 having a rectangular cut out portion 302 through which the seat support means 164 can operate in the forward and rearward directions. Tabs 304, 306 extend downwardly from the plate 300 to removably secure the cover 254 to the housing 34. Specifically, the tabs 304 removably engage the side walls 46 of the housing 34, while the tabs 306 engage the housing flanges 62. The cover 254 is preferably made of polystyrene.

Referring to FIGS. 1 and 2, the chair armrests 308 each comprise a generally triangular shaped metal frame (not shown) having a somewhat rounded upper portion. The armrests 308 are mounted on the end portions 194 of the seat support means 164 by bolts (not shown) engaging and extending through aligned holes 310 in the armrest frame and the end portions 194 (see FIG. 7.). The armrest frames are covered with a fabric or plastic material to provide comfort to the user.

While the invention has been described in connection with a preferred embodiment, it will be understood that the invention will not be limited to that embodiment. To the contrary, all alternative modifications and equivalents as may be included with the spirit and scope of the invention as defined by the appended claims are intended.

I claim:

1. In a chair control for adjusting height and tilt of a chair, said chair comprising a base and a column supported by said base, said chair control comprising height adjustment means, tilt adjustment means and a housing adapted to mount on said column for supporting a chair seat, said height adjustment means being mounted to and between said base and said housing for longitudinal adjustment to alter relative height of said seat and comprising height actuating means movably mounted to said housing for actuating longitudinal adjustment of said height adjustment means, said tilt adjustment means comprising chair back support means pivotally mounted on said housing for movement between upright and reclining positions, means for biasing said chair back support means in said upright position, tension control means movably engageable with said biasing means for adjusting tension thereof and tilt actuating means movably mounted to said housing for actuating movement of said tension control means, the improvement wherein:

said height actuating means and said tilt actuating means comprise a pair of discrete members extending coaxially and codirectionally outwardly from said housing.

2. A chair control according to claim 1, wherein said height actuating means and said tilt actuating means are mounted to said housing for rotation about a common longitudinal axis.

3. A chair control according to claim 2, wherein said tilt actuating means comprises an elongated rod rotatably mounted to said housing, and said height actuating means comprises an elongated tube rotatably mounted to said housing in telescopic relationship to said elongated rod.

4. A chair control according to claim 3, wherein said height adjustment means further comprises extendable means adapted to be positioned within said column and mounted to and between said base and said housing for longitudinal adjustment to alter height of the said chair seat relative to said base, and lock means movable between locked and unlocked positions to prevent and permit, respectively, adjustment of said extendable means; and said elongated tube is rotatably mounted to said housing for movement in actuating and return directions and is adapted to actuate movement of said lock means to said unlocked position when said elongated tube is rotated in said actuating direction.

5. A chair control according to claim 4, wherein said height adjustment means further comprises lever means movably mounted on said housing and engageable with said lock means to move said lock means to said unlocked position; and said elongated tube further comprises means for engaging said lever means to move said lock means to said unlocked position when said elongated tube is rotated in said actuating direction.

6. A chair control according to claim 5, wherein said lever means comprises a bar pivotally mounted to said housing and having first and second ends, said first end being adapted to pivotally engage said lock means to move said lock means to said unlocked position when said elongated tube is moved in said actuating direction; and said elongated tube comprises an inner end positioned adjacent said bar second end, an outer end extending outwardly from said housing an an opening extending through a wall of said tube inner end, said bar second end being positioned in registry with said opening, said engaging means comprising an edge of said tube defining said opening and adapted to engage said bar second end to move said bar first end into engagement with said lock means to move said lock means to said unlocked position.

7. A chair control according to claim 6, wherein said extendable means comprises a gas cylinder mounted to and between the chair base and said housing, and mounting said lock means to adjust length of said extendable means and thus chair height when said lock means is moved to said unlocked position.

8. A chair control according to claim 7, wherein said lock means comprises an upstanding pin movable between said locked and unlocked positions; and said lever means comprises a downwardly depending pin on said bar first end and positioned to engage said upstanding pin to move said upstanding pin to said unlocked position when said elongated tube is moved in said actuation direction.

9. A chair control according to claim 6, wherein said gas cylinder biases said lock means in said locked position, urging said bar first end out of engagement with said lock means and said elongated tube in said return direction.

10. A chair control according to claim 4, wherein said elongated rod is rotatably mounted to said housing for movement in tension and release directions;

said tilt adjustment means further comprises chair seat support means mounted to said housing for movement between rearward and forward positions and operably interconnected with said chair back support means;

said biasing means biases said seat support means and said back support means in said upright and said forward position, respectively;

said tension control means comprises a first block-like member mounted on said elongated rod and in said housing for reciprocal movement longitudinally of said rod in first and second directions transverse of directional movement of said seat support means, a second block-like member engaging said biasing means and mounted in said housing for reciprocal movement in said forward and rearward directions, first force transmitting means for translating rotational movement of said elongated rod in said tension and release directions into movement of said first block-like member in said first and second directions, and second force transmitting means adapted to coact between said first and second block-like members to translate movement of said first block-like member in said first and second directions into movement of said second block-like member in said forward and rearward directions to increase and decrease, respectively, tension of said biasing means;

whereby rotation of said elongated rod in said tension and release directions moves said first block-like member in said first and second directions and said second block-like member in said forward and rearward directions to increase and decrease, respectively, tension of said biasing means.

11. A chair control according to claim 10, wherein said elongated rod comprises inner and outer ends, said inner end being positioned in said housing, said outer end extending outwardly of said housing;

said first block-like member further comprises a bore extending therethrough and receiving said elongated rod at said inner end thereof; and said first force transmitting means comprises a threaded wall of said elongated rod at said inner end thereof, and a threaded inner wall of said first member defining said bore and complementary to and operably engaging said rod threaded wall.

12. A chair control according to claim 11, wherein said second force transmitting means comprises complementary planar surfaces on said first and second members and interengaged in a substantially common plane forming an acute angle greater than zero degrees relative to directional movement of said first member.

13. A chair control according to claim 12, wherein said housing comprises a pair of spaced first and second side walls, said first side wall having an opening extending therethrough, said second side wall having a hole therein aligned with said opening; and said elongated rod further comprises a pin on and extending longitudinally outwardly from said rod inner end, said rod being rotatably mounted to and between said side walls, with said rod outer end being received in said opening and said pin being received in said hole.

14. A chair control according to claim 12, wherein said tilt adjustment means further comprises first and second block-like means for guiding movement of said first and second members in said first and second and said forward and rearward directions, respectively.

15. A chair control according to claim 14, wherein said housing comprises a bottom wall;

said first guide means comprises a pair of spaced first inner walls extending upwardly from said bottom wall and longitudinally aligned with directional movement of said first block-like member, said first inner walls receiving said first block-like member therebetween and being engageable therewith to guide said first block-like member in first and second directions; and said second guide means comprises a pair of spaced second inner walls extending upwardly from said bottom wall and longitudinally aligned with directional movement of said second block-like member, said second inner walls receiving said second block-like member therebetween and being engageable therewith to guide said second block-like member in said forward and rearward directions.

16. A chair control according to claim 15, wherein said second guide means further comprises a channel formed in said housing bottom wall and longitudinally aligned with directional movement of said second block-like member, and a downwardly depending flange on said second block-like member, said channel receiving said flange to guide said second block-like member in said forward and rearward directions.

17. A chair control according to claim 12, wherein said biasing means is positioned between said seat support means and said second block-like member; and said tilt adjustment means further comprises means for mounting said biasing means to and between said seat support means and said second block-like member.

18. A chair control according to claim 17, wherein said biasing means comprises at least one coil spring positioned between said seat support means and said second block-like member and having front and rear ends; and said mounting means comprises at least one first pin extending rearwardly from a back surface of said seat support means and at least one second pin extending forwardly from a front surface of said second block-like member and linearly aligned with said first pin in parallel relationship to directional movement of said second block-like member, said spring front and rear ends engaging said rear and front surfaces of said seat support means and said second block-like member, respectively, with said first and second pins being received in said coil spring at said front and rear ends thereof, respectively.

19. A chair control according to claim 12, and further comprising track means mounted on said housing and longitudinally aligned with directional movement of said seat support means, and means for slidably mounting said seat support means to said track means for movement in said forward and rearward directions.

20. A chair control according to claim 19, wherein said track means comprises at least one retainer bracket mounted to said housing and having an elongated slot therein longitudinally aligned with directional movement of said second block-like member and formed by a pair of spaced flanges of said retainer bracket; and said mounting means comprises at least one pin on said seat support means and slidably received within said slot between said spaced flanges.

21. A chair control according to claim 20, wherein said mounting means further mounts said seat support means to said track means for rotational movement relative thereto; and said pin is substantially circular, in cross section, and is adapted to rotate in said slot;

whereby movement of said back support toward said reclining position in response to rearward forces applied thereto effects downward rotational movement of said seat support means along with movement thereof in said rearward direction.

22. In a chair control for adjusting height and tilt of a chair, said chair comprising a base, a longitudinally adjustable column supported by the base, a housing mounted to the column for supporting a seat and a back, said seat and back being movably mounted to the housing for movement between upright and reclining positions, a lock for locking the column at a fixed height, and a spring mounted to the housing for biasing the seat and back toward the upright position, the improvement in said chair control comprising:

a first member connected to the spring for adjusting the tension thereof; and a second member connected to the lock for actuating the lock to unlock the column whereby the height of the housing may be adjusted relative to the base;

wherein the first member and the second member extend coaxially and codirectionally outwardly from the housing.

23. A chair control according to claim 22, wherein the first member and the second member are mounted to the housing for rotating about a common longitudinal axis.

24. A chair control according to claim 23, wherein the first and second members are mounted in telescopic relationship to each other.

25. A chair control according to claim 24, wherein a gas cylinder is mounted to the column, and the lock comprises a pin extending from the gas spring, the first member being connected to the pin and adapted for movement in actuating and return directions, whereby the pin will be moved to unlock the gas cylinder when the first member is rotated in the actuating direction.

26. A chair control according to claim 25, wherein a lever having first and second ends is pivotally mounted to the housing, the first member is a tube having an opening extending through a wall thereof, the lever first end engages the pin, and the lever second end is received within the opening whereby the edge of the wall defining the opening is adapted to engage the lever second end when the first member is rotated in the actuating direction.

27. A chair control according to claim 26, wherein the pin is movable between upper and lower positions relative to the gas spring, the gas spring being locked when the pin is in the upper position and unlocked when the pin is in the lower position, and the pin is biased toward the upper position.

28. A chair control according to claim 24, wherein the chair control further comprises a plunger for supporting the seat and mounted to the housing for movement between rearward and forward positions; and a yoke for supporting the back, pivotally mounted to the housing and operably interconnected with the plunger for movement therewith.

29. A chair control according to claim 28, wherein the housing comprises a track longitudinally aligned with directional movement of the plunger, and the plunger is slidably mounted to the track for movement in the forward and rearward directions.

30. A chair control according to claim 28 further comprising a wedge mounted to the second member for movement longitudinally of the second member in first and second directions;

a carriage mounted within the housing for reciprocal movement in forward and rearward directions, said carriage having a bearing surface;

wherein the spring is disposed between the carriage and the plunger to bias the plunger away from the carriage, and the bearing surface bears against the wedge so that rotation of the second member moves the wedge in one of the first and second directions and the carriage in one of the forward and rearward directions, respectively, to thereby adjust the tension of the spring.

31. A chair control according to claim 30, wherein the spring is a helical coil spring having a first end and a second end;

the plunger has a first pin extending rearwardly therefrom which receives the coil spring first end; and the carriage has a second pin extending forwardly therefrom and axially aligned with the first pin, the second pin receiving the coil spring second end, whereby the coil spring will be axially aligned with directional movement of the carriage and plunger and will be free from lateral displacement relative thereto.

32. A chair control according to claim 30, wherein the wedge is threaded onto the second member.

33. A chair control according to claim 32, wherein the housing comprises a bottom wall; and a first pair of spaced walls extending upwardly from the bottom wall and longitudinally aligned with directional movement of the wedge, said first pair of walls receiving the wedge therebetween and being engageable therewith to guide the wedge in the first and second directions.

34. A chair control according to claim 33, wherein the housing further comprises a second pair of spaced walls extending upwardly from the bottom wall and longitudinally aligned with directional movement of the carriage, said second pair of walls receiving the carriage therebetween and being engageable therewith to guide the carriage in the forward and rearward directions.

35. A chair control according to claim 34, wherein the housing bottom wall has a channel formed therein and longitudinally aligned with directional movement of the carriage, and the carriage has a depending flange which is received in the channel to guide the carriage in the forward and rearward directions.

36. A chair control according to claim 35, wherein the spring is a helical coil spring having a first end and a second end;

the plunger has a first pin extending rearwardly therefrom which receives the coil spring first end; and the carriage has a second pin extending forwardly therefrom and axially aligned with the first pin, the second pin receiving the coil spring second end, whereby the coil spring will be axially aligned with directional movement of the carriage and plunger and will be free from lateral displacement relative thereto.

37. A chair control according to claim 36, wherein the housing comprises a track longitudinally aligned with directional movement of the plunger, and the plunger is slidably mounted to the track for movement in the forward and rearward directions.

38. A chair control according to claim 32, wherein the track is formed by a slot in a wall of the housing, and the plunger carries a third pin which is slidably and rotatably received within the slot whereby the plunger can move in the forward and rearward directions, and rotate relative to the housing as it moves.

39. A chair control according to claim 30, wherein the housing comprises a track longitudinally aligned with directional movement of the plunger, and the plunger is slidably mounted to the track for movement in the forward and rearward directions.

40. A chair control according to claim 39, wherein the track is formed by a slot in a wall of the housing, and the plunger carries a third pin which is slidably and rotatably received within the slot whereby the plunger can move in the forward and rearward directions, and rotate relative to the housing as it moves.

41. A chair control according to claim 22, wherein a gas cylinder is mounted to the column, and the lock comprises a pin extending from the gas spring, the first member being connected to the pin and adapted for movement in actuating and return directions, whereby the pin will be moved to unlock the gas cylinder when the first member is rotated in the actuating direction.

42. A chair control according to claim 41, wherein the lever having first and second ends is pivotally mounted to the housing, the first member is a tube having an opening extending through a wall thereof, the lever first end engages the pin, and the lever second end is received within the opening whereby the edge of the wall defining the opening is adapted to engage the lever second end when the first member is rotated in the actuating direction.

43. A chair control according to claim 22, wherein the chair control further comprises a plunger for supporting the seat and mounted to the housing for movement between rearward and forward positions; and a yoke for supporting the back, pivotally mounted to the housing and operably interconnected with the plunger for movement therewith.

44. A chair control according to claim 43, further comprising a wedge mounted to the second member for movement longitudinally of the second member in first and second directions;

a carriage mounted within the housing for reciprocal movement in forward and rearward directions, said carriage having a bearing surface;

wherein the spring is disposed between the carriage and the plunger to bias the plunger away from the carriage, and the bearing surface bears against the wedge so that rotation of the second member moves the wedge in one of the first and second directions and the carriage in one of the forward and rearward directions, respectively, to thereby adjust the tension of the spring.

45. A chair control according to claim 44, wherein the housing comprises a bottom wall; and a first pair of spaced walls extending upwardly from the bottom wall and longitudinally aligned with directional movement of the wedge, said first pair of walls receiving the wedge therebetween and being engageable therewith to guide the wedge in the first and second directions.

46. A chair control according to claim 45, wherein the housing further comprises a second pair of spaced walls extending upwardly from the bottom wall and longitudinally aligned with directional movement of the carriage, said second pair of walls receiving the carriage therebetween and being engageable therewith to guide the carriage in the forward and rearward directions.

47. A chair control according to claim 46, wherein the housing bottom wall has a channel formed therein and longitudinally aligned with directional movement of the carriage, and the carriage has a depending flange which is received in the channel to guide the carriage in the forward and rearward directions.

48. A chair control according to claim 47, wherein the spring is a helical coil spring having a first end and a second end;

the plunger has a first pin extending rearwardly therefrom which receives the coil spring first end; and the carriage has a second pin extending forwardly therefrom and axially aligned with the first pin, the second pin receiving the coil spring second end, whereby the coil spring will be axially aligned with directional movement of the carriage and plunger and will be free from lateral displacement relative thereto.

49. A chair control according to claim 48, wherein the housing comprises a track longitudinally aligned with directional movement of the plunger, and the plunger is slidably mounted to the track for movement in the forward and rearward directions.

50. A chair control according to claim 49, wherein the track is formed by a slot in a wall of the housing, and the plunger carries a third pin which is slidably and rotatably received within the slot whereby the plunger can move in the forward and rearward directions, and rotate relative to the housing as it moves.

* * * * *

UNITED STATES PATENT AND TRADEMARK OFFICE

CERTIFICATE OF CORRECTION

PATENT NO. : 5,106,157

DATED : April 21, 1992

INVENTOR(S) : ROBERT A. NAGELKIRK ET AL

It is certified that error appears in the above-identified patent and that said Letters Patent is hereby corrected as shown below:

Col. 14, Claim 14, Line 1, delete "block-like".

Col. 14, Claim 14, Line 2, insert after "second" --block-like--.

Col. 15, Claim 23, Line 35, "rotating" should be --rotation--.

Col. 17, Claim 42, Line 33, "the lever" should be --a lever--.

Col. 17, Claim 38, Line 8, "32," should be --37,--.

Signed and Sealed this

Tenth Day of August, 1993

*Attest:*

Michael K. Kirk

MICHAEL K. KIRK

*Attesting Officer*

*Acting Commissioner of Patents and Trademarks*